US007997250B2

(12) United States Patent
Nakahara et al.

(10) Patent No.: US 7,997,250 B2
(45) Date of Patent: Aug. 16, 2011

(54) UPPER STRUCTURE OF ENGINE

(75) Inventors: Yasushi Nakahara, Hiroshima (JP); Hidesaku Ebesu, Hiroshima (JP); Tsuyoshi Yamamoto, Hiroshima (JP); Keiichi Tateishi, Hiroshima (JP)

(73) Assignee: Mazda Motor Corporation (JP)

( * ) Notice: Subject to any disclaimer, the term of this patent is extended or adjusted under 35 U.S.C. 154(b) by 362 days.

(21) Appl. No.: 12/265,836

(22) Filed: Nov. 6, 2008

(65) Prior Publication Data

US 2009/0114174 A1 May 7, 2009

(30) Foreign Application Priority Data

Nov. 7, 2007 (JP) ..... 2007-289931
Oct. 7, 2008 (JP) ..... 2008-260664

(51) Int. Cl.
*F02B 31/00* (2006.01)
*F02P 15/02* (2006.01)
*H01F 38/12* (2006.01)

(52) U.S. Cl. ..... 123/309; 123/310; 123/634; 123/635; 123/638; 123/647

(58) Field of Classification Search ..... 123/309, 123/310, 634, 635, 638, 647, 58.1
See application file for complete search history.

(56) References Cited

U.S. PATENT DOCUMENTS 5,954,024 A * 9/1999 Duhr et al. ..... 123/310
6,405,708 B1 * 6/2002 Watson ..... 123/406.6
6,536,406 B2 * 3/2003 Matsubara et al. ..... 123/310
6,559,647 B1 * 5/2003 Bidner et al. ..... 324/393
6,959,687 B2 * 11/2005 Iizuka et al. ..... 123/310
7,117,860 B1 * 10/2006 Chittum ..... 123/635
7,188,589 B2 * 3/2007 Tayama et al. ..... 123/41.82 R
7,559,319 B2 * 7/2009 Idogawa et al. ..... 123/652
2001/0017125 A1 8/2001 Matsubara et al.
2009/0107457 A1 * 4/2009 Meyer et al. ..... 123/310
2009/0229569 A1 * 9/2009 Glugla et al. ..... 123/406.2

FOREIGN PATENT DOCUMENTS

JP S60-43178 U 3/1985

OTHER PUBLICATIONS

Japanese Office Action "Notice of Reasons for Rejection" dated May 10, 2011; Japanese Patent Application No. 2008-260664 with translation.

* cited by examiner

*Primary Examiner* — Thomas N Moulis
(74) *Attorney, Agent, or Firm* — Studebaker & Brackett PC; Donald R. Studebaker

(57) ABSTRACT

Disclosed is an upper structure of an engine having three or more cylinders arranged in a row. A first one of a pair of adjacent cylinders among at least three of the cylinders serially arranged in a cylinder row direction is provided with a second spark plug at a position on an opposite side of a second one of the pair of adjacent cylinders, and the second one of the pair of adjacent cylinders is provided with a second spark plug at a position on an opposite side of the first one of the pair of adjacent cylinders. The present invention can provide enhanced flexibility in design of a head cover of the engine.

6 Claims, 6 Drawing Sheets

UPPER STRUCTURE OF ENGINE

BACKGROUND OF THE INVENTION

1. Field of the Invention

The present invention relates to an upper structure of an engine, and primarily to an arrangement structure of an ignition system.

2. Description of the Background Art

As an ignition coil adapted to be used for generating sparks from a spark plug of an engine, a stick-type ignition coil unit is widely employed which is capable of being inserted into a plug hole in a cylinder head from above a head cover of an engine. This type of ignition coil unit has a head portion which is exposed above the head cover and provided with a connector adapted to allow an electric wire to be connected thereto. Thus, an operation of connecting the electric wire to the connector and replacing the ignition coil unit with a new one can be performed without detaching the head cover. As one of the engine combustion control techniques, a multi-point ignition engine equipped with a plurality of spark plugs per cylinder has been proposed (see, for example, JP 2001-234842A).

In the multi-point ignition engine having an ignition coil unit for each spark plug, the number of ignition coil units will multiplicatively increase. Consequently, an area on a head cover to be occupied by head portions of ignition coil units becomes larger to cause difficulty in ensuring a space for arranging other component, such as an oil filler section, and deterioration of flexibility in design of the head cover.

SUMMARY OF THE INVENTION

In view of the above circumstances, it is an object of the present invention to provide enhanced flexibility in design of a head cover in an engine equipped with a plurality of spark plugs per cylinder.

In order to achieve the above object, the present invention provides an upper structure of an engine having three or more cylinders arranged in a row, which comprises: a first spark plug provided in each of the cylinders and disposed approximately on a center line of a corresponding one of the cylinders; a second spark plug provided in each of the cylinders and disposed apart from the first spark plug in a cylinder row direction; and an ignition coil unit connected to each of the first and second spark plugs, wherein the ignition coil unit has a connection pipe portion adapted to be inserted into a plug hole and connected to the first or second spark plug through a distal end thereof, and a head portion provided on the side of a base end of the connection pipe portion and adapted to be exposed above a head cover of the engine. In the upper structure, a first one of a pair of adjacent cylinders among at least three of the cylinders serially arranged in the cylinder row direction is provided with the second spark plug at a position on an opposite side of a second one of the pair of adjacent cylinders, and the second one of the pair of adjacent cylinders is provided with the second spark plug at a position on an opposite side of the first one of the pair of adjacent cylinders.

BRIEF DESCRIPTION OF THE DRAWINGS

FIGS. 2A and 2B illustrate a structure surrounding a combustion chamber, wherein FIG. 2A is a sectional view taken along the line I-II in FIG. 1, and FIG. 2B is a sectional view taken along the line II-III in FIG. 1.

FIGS. 3A to 3C illustrate details of an ignition coil unit 20, wherein FIG. 3A, FIG. 3B and FIG. 3C are a top plan view, a bottom view and a left side view, respectively.

FIGS. 4A to 4C illustrate details of an ignition coil unit 30, wherein FIG. 4A, FIG. 4B and FIG. 4C are a top plan view, a bottom view and a left side view, respectively.

FIGS. 5A and 5B illustrate a structure of a fixed portion between a head cover 10 and each of the ignition coil units 20, 30, wherein FIG. 5A is a sectional view taken along the line X-X in FIG. 1, and FIG. 5B is a sectional view taken along the line Y-Y in FIG. 1.

DESCRIPTION OF THE PREFERRED EMBODIMENTS

Figure 1:
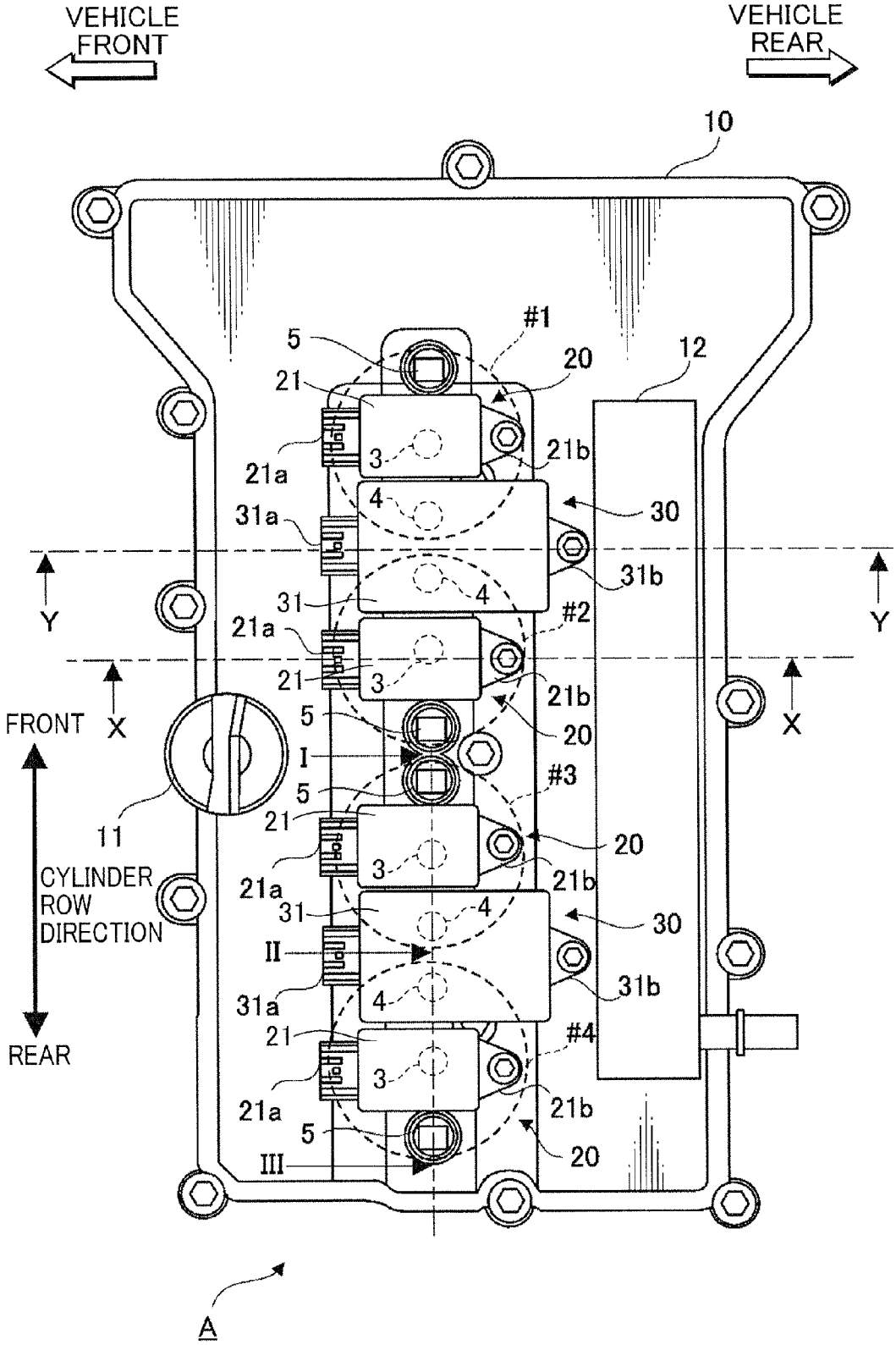
FIG. 1 is a fragmentary top plan view showing an upper structure of an engine A, according to one embodiment of the present invention.
Figure 2A:
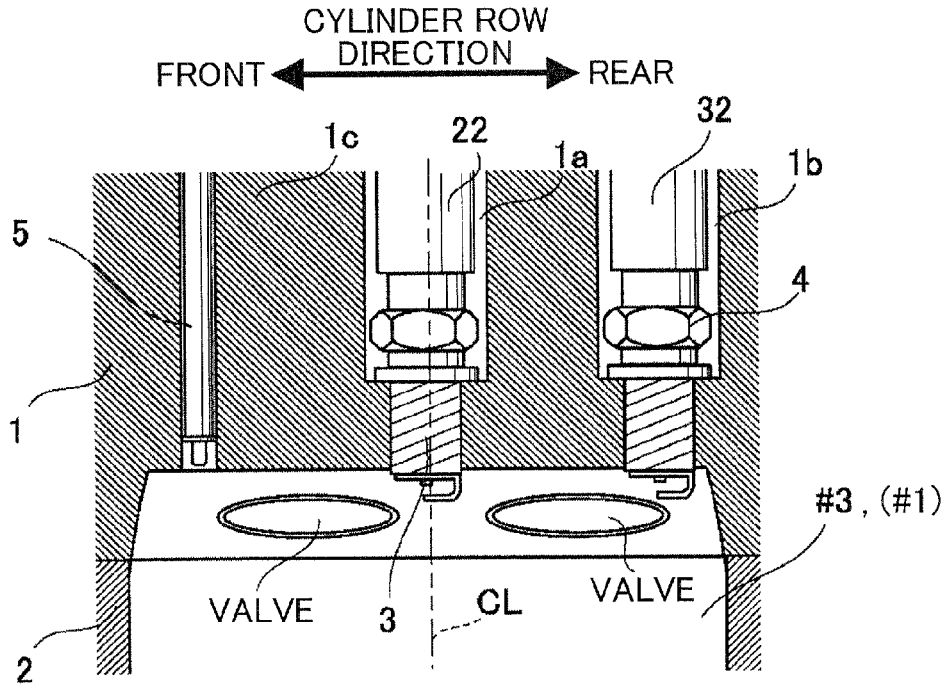
Figure 2B:
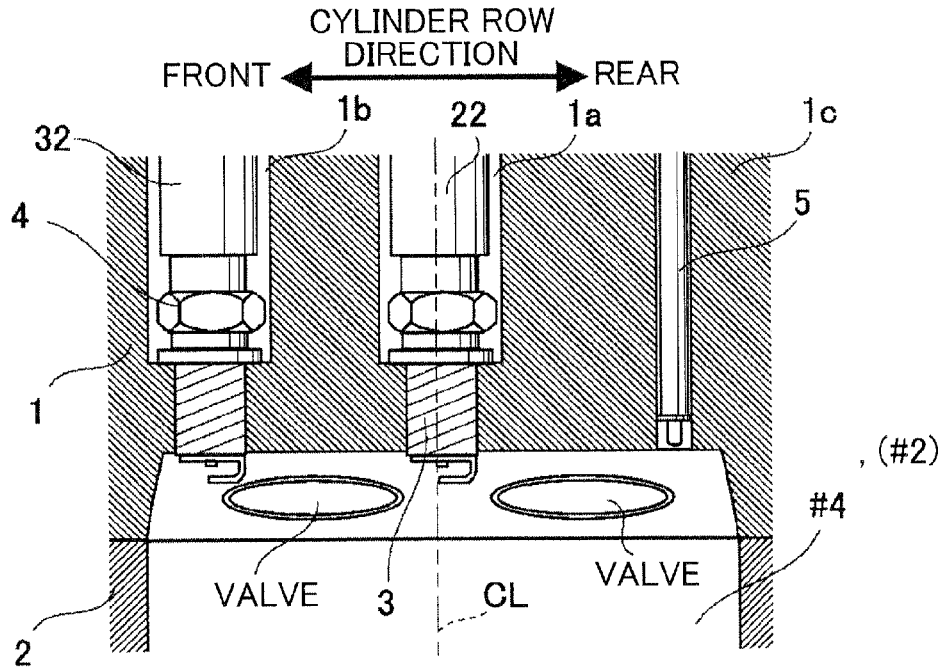

FIG. 1 is a fragmentary top plan view showing an upper structure of an engine A, according to one embodiment of the present invention. FIG. 2A is a sectional view showing a structure surrounding one combustion chamber, taken along the line I-II in FIG. 1, and FIG. 2B is a sectional view showing a structure surrounding another combustion chamber, taken along the line II-III in FIG. 1. As shown in FIGS. 1, 2A and 2B, the engine A is an inline four-cylinder gasoline engine having four cylinders #1 to #4 arranged in a row in a direction from a front end to a rear end thereof.

The engine A is an on-vehicle engine adapted to be transversely mounted in an engine compartment (not shown) formed at a front end of a vehicle body, in such a manner that a cylinder row direction (i.e., an arrangement direction of the cylinders #1 to #4) is oriented in a widthwise direction of the vehicle body. In FIG. 1, a left side corresponds to a frontward side of the vehicle body, and an intake system (not shown) is disposed on a lateral side of the engine A which corresponds to the frontward side of the vehicle body. In FIG. 1, a right side corresponds to a rearward side of the vehicle body, and an exhaust system (not shown) is disposed on a lateral side of the engine A which corresponds to the rearward side of the vehicle body.

In the engine A, respective combustion chambers of the cylinders #1 to #4 are defined by a cylinder head 1 and a cylinder block 2 (see FIGS. 2A and 2B), and a head cover 10 is provided above the cylinder head 1 to cover a top surface of the cylinder head 1. The engine A is designed as a high-compression engine in which a geometric compression ratio is set in the range of 13 to 15, and as a multi-point ignition engine in which two spark plugs consisting of first and second spark plugs 3, 4 are provided in each of the four cylinders #1 to #4. The engine A also has an in-cylinder pressure sensor 5 provided in each of the four cylinders #1 to #4 to detect an internal pressure of each combustion chamber so as to detect a sign of auto-ignition phenomenon or the like.

Each of the first spark plugs 3 is inserted into a corresponding one of four plug holes la formed in the cylinder head 1, and disposed such that an axis thereof is approximately aligned with a center line CL of a corresponding one of the four cylinders #1 to #4. The first spark plug 3 is positioned to allow a distal end thereof to be exposed to the combustion chamber of the corresponding cylinder, wherein a base end of the first spark plug 3 is connected to a distal end of a connection pipe portion 22 of an after-mentioned ignition coil unit 20.

Each of the second spark plugs 4 is inserted into a corresponding one of four plug holes 1*b* formed in the cylinder head 1, and positioned to allow a distal end thereof to be exposed to the combustion chamber of a corresponding one of the four cylinders #1 to #4, wherein a base end of the second spark plug 4 is connected to a distal end of a connection pipe portion 32 of an after-mentioned ignition coil unit 30. In each of the four cylinders #1 to #4, the second spark plug 4 is disposed apart from the first spark plug 3 in the cylinder row direction, and in such a manner that an axis of the second spark plug 4 extends approximately parallel to the axis of the first spark plug 3.

As shown in FIGS. 1 and 2A, in each of the cylinder #1 and the cylinder #3 among the four cylinders #1 to #4, the second spark plug 4 is disposed apart from the first spark plug 3 on a rear side in the cylinder row direction (i.e., on a lower side in FIG. 1). On the other hand, the in-cylinder pressure sensor 5 is disposed apart from the first spark plug 3 on a front side in the cylinder row direction (i.e., an upper side in FIG. 1).

As shown in FIGS. 1 and 2B, in each of the cylinder #2 and the cylinder #4 among the four cylinders #1 to #4, the second spark plug 4 is disposed apart from the first spark plug 3 on the front side in the cylinder row direction. On the other hand, the in-cylinder pressure sensor 5 is disposed apart from the first spark plug 3 on the rear side in the cylinder row direction.

That is, in this embodiment, among the four cylinders #1 to #4 serially arranged in the cylinder row direction, the cylinder #1 is provided with the second spark plug 4 at a position on the side of the cylinder #2, and the cylinder #2 is provided with the second spark plug 4 at a position on the side of the cylinder #1. Further, the cylinder #3 is provided with the second spark plug 4 at a position on the side of the cylinder #4, i.e., on an opposite side of the cylinder #2, and the cylinder #4 is provided with the second spark plug 4 at a position on the side of the cylinder #3.

Thus, each of the two second spark plugs 4 in the cylinder #1 and the cylinder #2 which are located on the front side (the upper side in FIG. 1) of the engine A in the cylinder row direction is disposed on the side of an adjacent one of the cylinder #1 and the cylinder #2, and each of the two second spark plugs 4 in the cylinders #3 and the cylinder #4 which are located on the rear side (the lower side in FIG. 1) of the engine A in the cylinder row direction is disposed on the side of an adjacent one of the cylinder #3 and the cylinder #4.

Figure 3A:
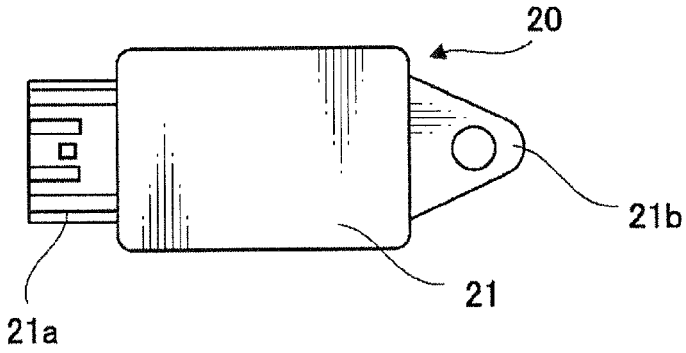
Figure 3B:
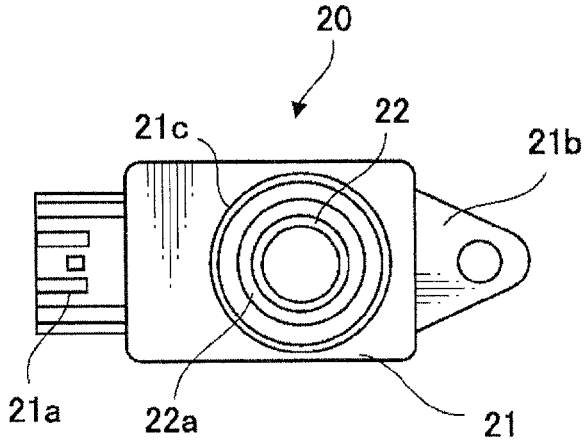
Figure 3C:
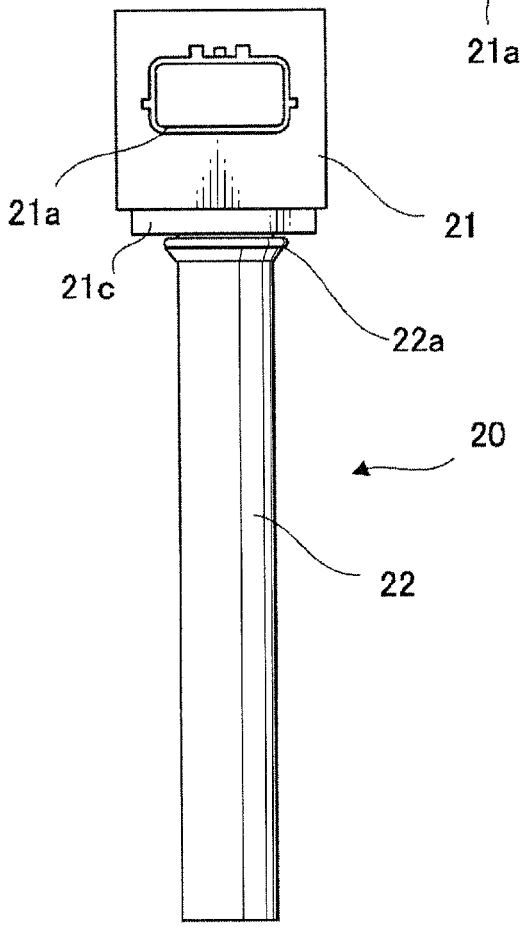

The following description will be made about an ignition coil unit 20. FIG. 3A, FIG. 3B and FIG. 3C are a top plan view, a bottom view and a left side view of the ignition coil unit 20, respectively. The ignition coil unit 20 has a head portion 21 and a connection pipe portion 22. The head portion 21 is provided with a connector 21*a* on one side thereof, and a bracket 21*b* on the other side. The connector 21*a* is adapted to allow an electric wire for transmitting a control signal from an engine control unit (ECU) and an electric wire for supplying electric power from a battery to be connected thereto. The bracket 21*b* is formed with a hole for fixing the ignition coil unit 20 to the head cover 10. As shown in FIG. 1, the ignition coil unit 20 is fixed to the head cover 10 while allowing the head portion 21 to be exposed above the head cover 10.

The head portion 21 is formed as a hollow casing member in which related components, such as an ignitor, and a part of primary/secondary coils and center/outer cores, are received. The connection pipe portion 22 is connected to a bottom surface of the head portion 21 through a base end thereof, and the bottom surface of the head portion 21 is provided with a circular ring-shaped outer-periphery sealing member 21*c* surrounding the connection pipe portion 22.

The connection pipe portion 22 is formed as a cylindrical-shaped member in which related components, such as primary/secondary coils and center/outer cores, are received. The connection pipe portion 22 is inserted into the plug hole 1*a*, and a distal end of the connection pipe portion 22 is connected to the first spark plug 3 (see FIGS. 2A and 2B). The connection pipe portion 22 has a circular ring-shaped inner-periphery sealing member 22*a* provided on the base end thereof to surround the connection pipe portion 22 (i.e., to extend a circumferential direction thereof).

Figure 5A:
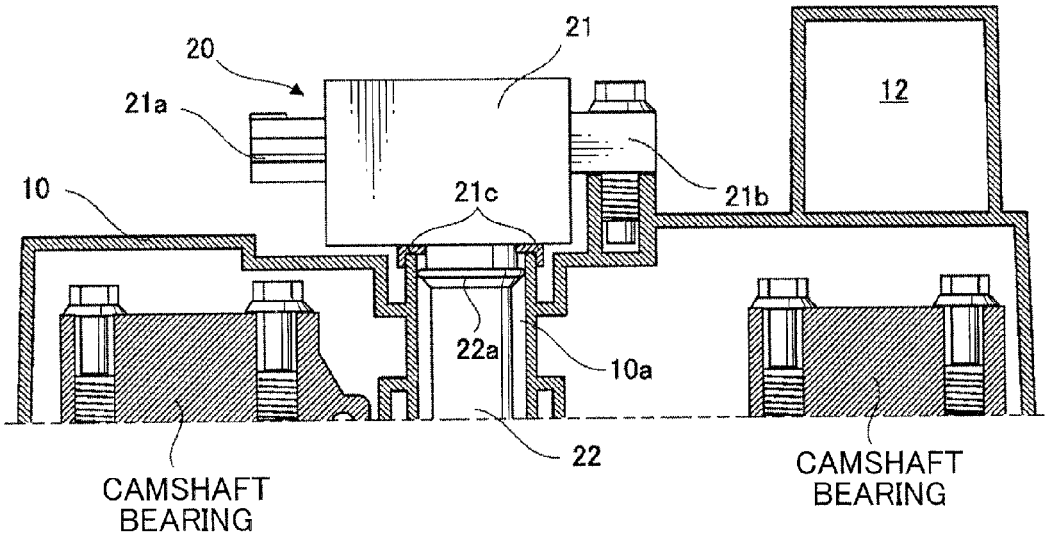

The ignition coil unit 20 is provided for each of the first spark plugs 3. That is, in this embodiment, the ignition coil unit 20 is provided in a number of four, which is equal to the number of cylinders, as shown in FIG. 1. FIG. 5A is a sectional view taken along the line X-X in FIG. 1, which shows a structure of a fixed portion between the ignition coil unit 20 and the head cover 10. As shown in FIG. 5A, the head cover 10 is provided with a cylindrical-shaped plug hole portion 10*a* for each of the four ignition coil units 20. In an operation of attaching each of the four ignition coil units 20, the connection pipe portion 22 is inserted into a corresponding one of the four plug hole portions 10*a* of the head cover 10 and a corresponding one of the four plug holes 1*a* of the cylinder head 1 from above the head cover 10. Then, the outer-periphery sealing member 21*c* is brought into close contact with an outer peripheral surface of the plug hole portion 10*a*, and the inner-periphery sealing member 22*a* is brought into close contact with an inner peripheral surface of the plug hole portion 10*a*, so that sealing between the connection pipe portion 22 and the head cover 10, particularly between the connection pipe portion 22 and the plug hole portion 10*a*, is achieved.

Figure 4A:
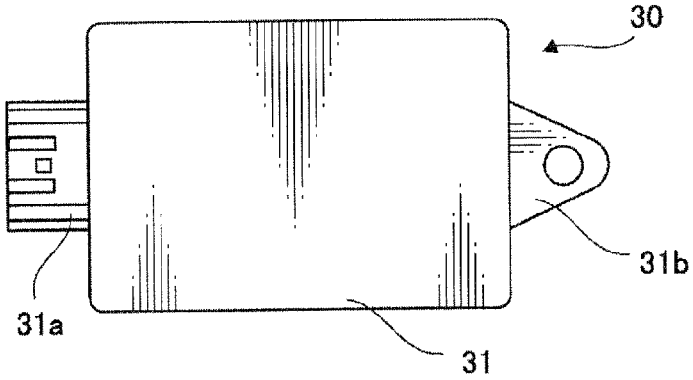
Figure 4B:
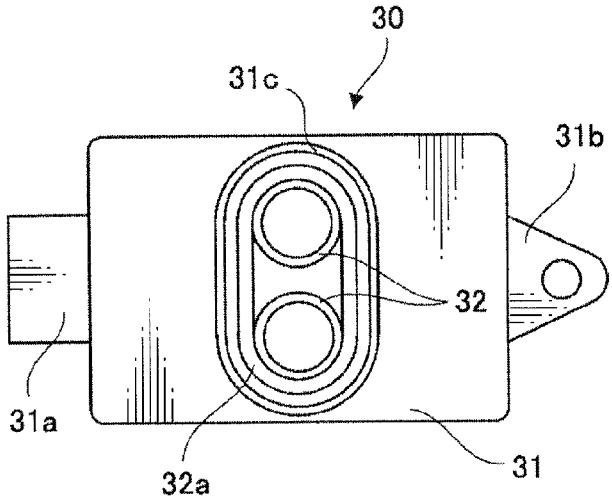
Figure 4C:
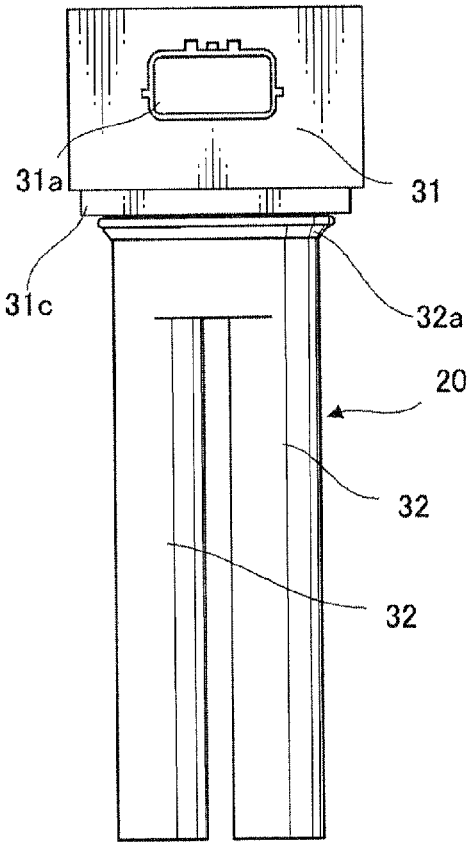

The following description will be made about an ignition coil unit 30. FIG. 4A, FIG. 4B and FIG. 4C are a top plan view, a bottom view and a left side view of the ignition coil unit 30, respectively. The ignition coil unit 30 is formed as an integral-type ignition coil unit to be shared by two cylinders. Specifically, the ignition coil unit 30 has a common head portion 31 and two connection pipe portions 32. The head portion 31 is adapted to be shared by two cylinders to facilitate reduction in size of ignition coils for two cylinders.

The head portion 31 is provided with a connector 31*a* on one side thereof, and a bracket 31*b* on the other side. The connector 31*a* is adapted to allow an electric wire for transmitting a control signal from the engine control unit (ECU) and an electric wire for supplying electric power from the battery to be connected thereto. The bracket 31*b* is formed with a hole for fixing the ignition coil unit 30 to the head cover 10. As shown in FIG. 1, the ignition coil unit 30 is fixed to the head cover 10 while allowing the head portion 31 to be exposed above the head cover 10.

The head portion 31 is formed as a hollow casing member in which related components, such as a pair of ignitors associated with respective ones of the adjacent two second spark plugs 4, and a part of primary/secondary coils and center/outer cores, are received. The two connection pipe portions 32 for the adjacent two second spark plugs 4 are connected to a bottom surface of the head portion 31 through base ends thereof.

Each of the two connection pipe portions 32 is formed as a cylindrical-shaped member in which related components, such as primary/secondary coils and center/outer cores, are received. The two connection pipe portions 32 are disposed in side-by-side relation in the cylinder row direction in a state after the ignition coil unit 30 is mounted to the engine A, and the base ends of the connection pipe portions 32 are integrated into a single base end having an oval outer shape in cross-section. Each of the two connection pipe portions 32 is inserted into a corresponding one of adjacent two of the four plug holes 1*b*, and a distal end of each of the two connection pipe portions 32 is connected to a corresponding one of the two adjacent second spark plugs 3 (see FIGS. 2A and 2B).

The bottom surface of the head portion 31 is provided with an oval ring-shaped outer-periphery sealing member 31*c* surrounding the two connection pipe portions 32. Further, the two connection pipe portions 32 have an oval ring-shaped inner-periphery sealing member 32*a* provided on the integral base end thereof to surround the connection pipe portions 32 (i.e., to extend in a circumferential direction thereof).

The ignition coil unit 30 is shared by the two adjacent second spark plugs 4. That is, in this embodiment, the ignition coil unit 30 is provided in a number of two, which is one-half of the number of cylinders, as shown in FIG. 1. More specifically, one ignition coil unit 30 is provided for the cylinders #1 and the cylinder #2 which are located on the front side of the engine A in the cylinder row direction, and one ignition coil unit 30 is provided for the cylinders #3 and the cylinder #4 which are located on the rear side of the engine A in the cylinder row direction.

Figure 5B:
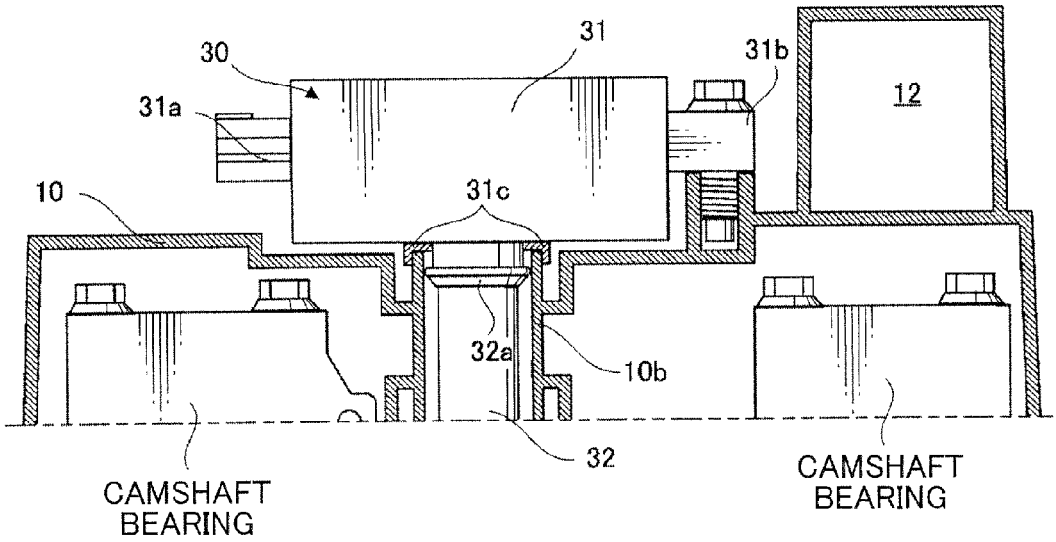

FIG. 5B is a sectional view taken along the line Y-Y in FIG. 1, which shows a structure of a fixed portion between the ignition coil unit 30 and the head cover 10. As shown in FIG. 5B, the head cover 10 is provided with a plug hole portion 10*b* adapted to allow the two connection pipe portions 32 of each of the ignition coil units 30 to be inserted thereinto. More specifically, the plug hole portion 10*b* is formed in an oval shape elongated in the cylinder row direction, and provided for each of the group of cylinders #1, #2 and the group of cylinders #3, #4, (i.e., in a total number of two). Thus, the two connection pipe portions 32 of the ignition coil unit 30 associated with the group of cylinders #1, #2 are inserted into one of the two plug hole portions 10*b*, and the two connection pipe portions 32 of the ignition coil unit 30 associated with the group of cylinders #3, #4 are inserted into the other plug hole portion 10*b*.

In an operation of attaching each of the two ignition coil units 30, the two connection pipe portions 32 of the ignition coil unit 30 are inserted into a corresponding one of the two plug hole portions 10*b* of the head cover 10 and respective ones of corresponding two of the four plug holes 1*b* of the cylinder head 1 from above the head cover 10. Then, the outer-periphery sealing member 31*c* is brought into close contact with an outer peripheral surface of the plug hole portion 10*b*, and the inner-periphery sealing member 32*a* is brought into close contact with an inner peripheral surface of the plug hole portion 10*b*, so that sealing between the head cover 10 and the two connection pipe portions 32, particularly between the plug hole portion 10*b* and the two connection pipe portions 32, is achieved. The outer-periphery sealing member 31*c* and the inner-periphery sealing member 32*a* each formed in an oval ring shape surrounding the two connection pipe portions 32 make it possible to adequately ensure sealing performance while allowing the two connection pipe portions 32 to be arranged closer to each other so as to facilitate reduction in size of the ignition coil unit 30.

Referring to FIG. 1, the ignition coil units 20, 30 are disposed in a central region of the head cover 10 in a widthwise direction of the head cover 10 (i.e., in a direction orthogonal to the cylinder row direction). All the connectors 21*a*, 31*a* of the head portions 21, 31 of the ignition coil units 20, 30 are arranged to protrude toward a left side in FIG. 1 which corresponds to an intake side of the engine A (i.e., one lateral side of the engine A on the frontward side of the vehicle body).

The head cover 10 is provided with an oil filler section 11 at a position apart from a widthwise middle position thereof and on a left side in FIG. 1 (i.e., on the frontward side of the vehicle body) relative to the widthwise middle position, and an oil separator chamber 12 for blow-by gas, at a position apart from the widthwise middle position and on a right side in FIG. 1 (i.e., on the rearward side of the vehicle body) relative to the widthwise middle position. The oil filler section 11 is located between the cylinders #2 and the cylinder #3 when viewed in the cylinder row direction.

Advantages of the upper structure of the engine A according to the above embodiment will be described below. In the above embodiment, the second spark plugs 4 are arranged in the above manner. Thus, on the head cover 10, the ignition coil unit 30 for the second spark plugs 4 does not exist between the two ignition coil units 20 associated with the respective first spark plugs 3 of the pair of adjacent cylinders #2, #3. A resulting space can be utilized to efficiently arrange other component (in the above embodiment, the oil filler section 11) on the head cover 10 without causing interference with the ignition coil units 20, 30, to achieve enhanced flexibility in design of the head cover 10. In addition, the ignition coil unit 30 for the two second spark plugs 4 disposed in the cylinders #1, #2 in adjacent relation to each other is formed as the integral-type ignition coil unit having the head portion 31 shearable by two cylinders. Similarly, the ignition coil unit 30 for the two second spark plugs 4 disposed in the cylinders #3, #4 is formed as the integral-type ignition coil unit. This makes it possible to reduce an installation space required for the ignition coil unit 30 for two cylinders, and allow the ignition coil unit 30 for two cylinders to be simultaneously attached or detached so as to achieve enhanced efficiency of a maintenance operation.

Generally, auxiliary units are disposed on a front end of an engine in a cylinder row direction. Thus, it is undesirable to arrange the oil filler section 11 on the front side of the head cover 10 in the cylinder row direction. In the above embodiment, an installation space for the oil filler section 11 is formed at a position between the cylinder #2 and the cylinder #3, i.e., approximately at a middle position in the cylinder row direction. This makes it possible to more effectively enhance the flexibility in design of the head cover 10. Considering a risk of leakage or scattering of oil or oil mist around the engine during an operation of replenishing oil, it is particularly desired to arrange the oil filler section 11 at a position away from an auxiliary unit susceptible to deterioration due to oil, such as an alternator, as far as possible. In the above embodiment, the oil filler section 11 is provided in a lateral region of the head cover 10, at an approximately middle position in the cylinder row direction. This makes it possible to arrange the oil filler section 11 at a position sufficiently away from the auxiliary unit so as to effectively prevent oil or oil mist leaked or scattered from the oil filler section 11 from attaching onto the auxiliary unit.

In the above embodiment, the connectors 21*a*, 31*a* are arranged to be oriented in the same direction. This makes it possible to achieve enhanced efficiency of a maintenance operation, such as an operation of connecting an electric wire to each of the connectors 21*a*, 31*a*. Particularly, in the above embodiment, the connectors 21*a*, 31*a* are arranged to be oriented in the frontward direction of the vehicle body. Thus, the maintenance operation, such as an operation of connecting an electric wire to each of the connectors 21*a*, 31*a*, can be readily performed from a frontward end of the engine compartment. In addition, the oil filler section 11 is disposed at a position offset on the frontward side of the vehicle body relative to the widthwise middle position of the head cover 10 (i.e., the middle position of the head cover 10 in a direction orthogonal to the cylinder row direction). Thus, the operation of replenishing oil can also be readily performed from the frontward end of the engine compartment.

Figure 6:
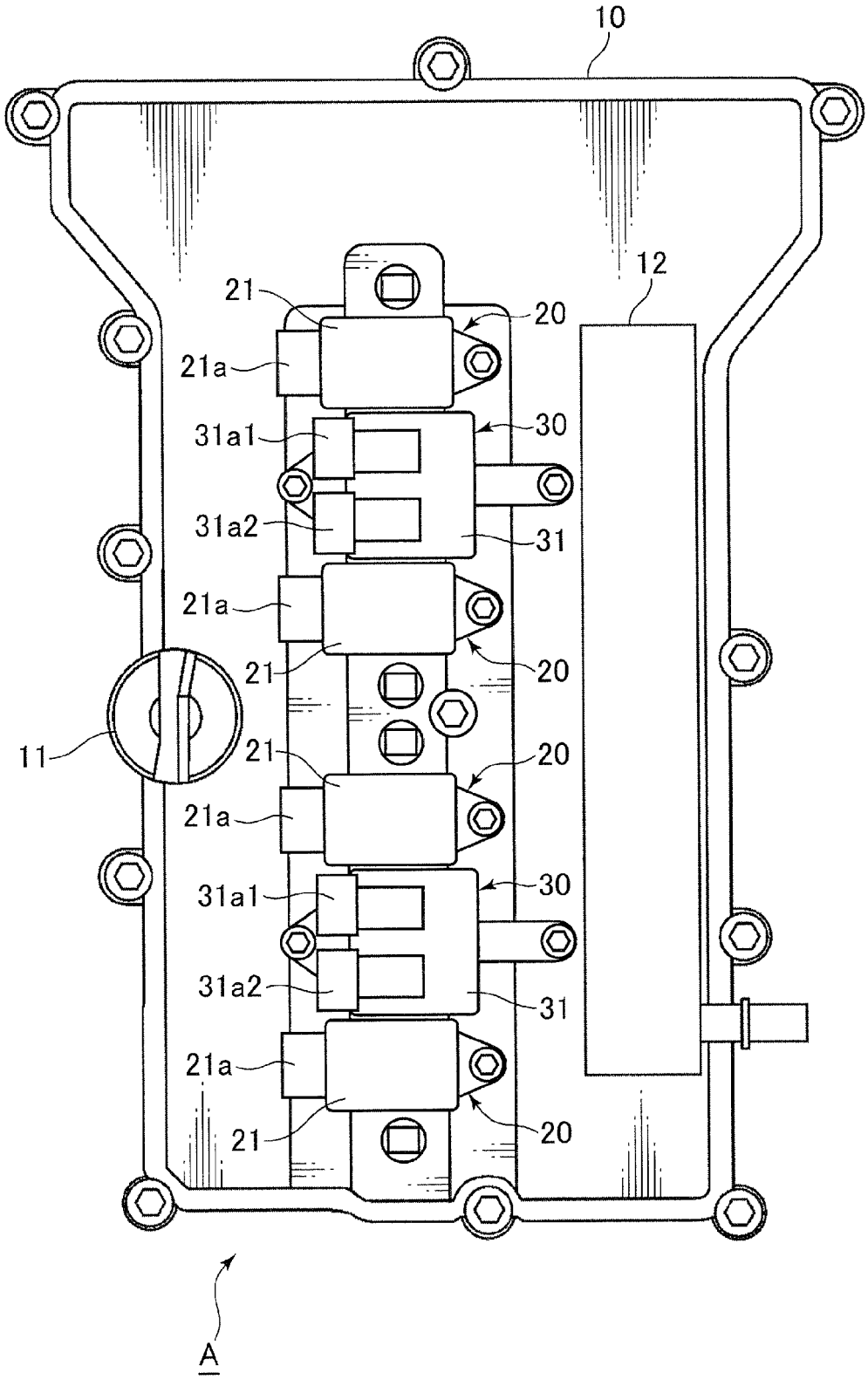
FIG. 6 is an explanatory top plan view showing one example of modification of the upper structure.

In the above embodiment, the single common connector 31*a* adapted to allow an electric wire to be connected thereto is provided to the head portion 31 of the integral-type ignition coil unit 30 associated with the two second spark plugs 4 in each of the group of cylinders #1, #2 and the group of cylinders #3, #4, and a control signal and electric power are sent to each of the two second spark plugs 4 through the single common connector 31*a*. Alternatively, as shown in FIG. 6, a pair of independent connectors 31*a*1, 31*a*2 associated with respective ones of the two second spark plugs 4 may be provided to the head portion 31 of the integral-type ignition coil unit 30.

In the above embodiment, the integral-type ignition coil unit 30 is provided in association with the two second spark plugs 4 in the two cylinders (the group of cylinders #1, #2, or the group of cylinders #3, #4) where the two second spark plugs 4 are disposed adjacent to each other. Alternatively, one independent-type ignition coil unit associated with a respective one of the two second spark plugs 4 may be provided in each of the two cylinders.

The above embodiment has been described on an assumption that the two cylinders #2, #3 located on a middle side in the cylinder row direction correspond to the "pair of adjacent cylinders" set forth in the appended claims, based on the arrangement where the second spark plug 4 of the cylinder #2 among the four cylinders #1 to #4 of the inline four-cylinder engine A is disposed on the opposite side of the cylinder #3, and the second spark plug 4 of the cylinder #3 is disposed on the opposite side of the cylinder #2. It is understood that the same arrangement as that described above may be applied to the group of cylinders #1, #2 or the group of cylinders #3, #4.

For example, in case where the group of cylinders #1, #2 correspond to the "pair of adjacent cylinders" set forth in the appended claims, the second spark plug 4 of the cylinder #1 is disposed on the opposite side of the cylinder #2, and the second spark plug 4 of the cylinder #2 is disposed on the opposite side of the cylinder #1. In this case, the second spark plug 4 of the cylinder #3 adjacent to the group of cylinders #1, #2 may be disposed on the side of the cylinder #2, so that the respective second spark plugs 4 of the cylinder #2 and the cylinder #3 are disposed adjacent to each other. Thus, the integral-type ignition coil unit 30 can be provided for the respective second spark plugs 4 of the cylinder #2 and the cylinder #3.

Although the above embodiment has been described based on one example where the present invention is applied to the inline four-cylinder engine A, an engine to be covered by the present invention is not limited to the inline four-cylinder engine, but the present invention may be suitably applied to other type of engine, such as an inline three-cylinder engine, an inline five-cylinder engine, an inline six-cylinder engine, or a V-type engine having three or more cylinders per bank.

In the last place, features of the present invention disclosed based on the above embodiment and advantages thereof will be comprehensively described.

The present invention provides an upper structure of an engine (A) having three or more cylinders (#1 to #4) arranged in a row, which comprises: a first spark plug (3) provided in each of the cylinders (#1 to #4) and disposed approximately on a center line (CL) of a corresponding one of the cylinders (#1 to #4); a second spark plug (4) provided in each of the cylinders (#1 to #4) and disposed apart from the first spark plug (3) in a cylinder row direction; and an ignition coil unit (20, 30) connected to each of the first and second spark plugs (3, 4), wherein the ignition coil unit (20, 30) has a connection pipe portion (22, 32) adapted to be inserted into a plug hole (1*a*, 1*b*) and connected to the first or second spark plug (3, 4) through a distal end thereof, and a head portion (21, 31) provided on the side of a base end of the connection pipe portion (22, 32) and adapted to be exposed above a head cover (10) of the engine (A). In the upper structure, a first one (#2 or #3) of a pair of adjacent cylinders (#2, #3) among at least three of the cylinders (#1 to #4) serially arranged in the cylinder row direction is provided with the second spark plug (4) at a position on an opposite side of a second one (#3 or #2) of the pair of adjacent cylinders (#2, #3), and the second one (#3 or #2) of the pair of adjacent cylinders (#2, #3) is provided with the second spark plug (4) at a position on an opposite side of the first one (#2 or #3) of the pair of adjacent cylinders (#2, #3).

In the upper structure of the present invention, a space is formed on the bead cover (10) at a position between the two ignition coil units (20) associated with the respective first spark plugs (3) of the pair of adjacent cylinders (#2, #3). The space can be utilized to efficiently arrange other component to achieve enhanced flexibility in design of the head cover (10).

Preferably, in the upper structure of the present invention, a remaining one (#1 or #4) of the at least three cylinders adjacent to the pair of adjacent cylinders (#2, #3) is provided with the second spark plug (4) at a position on the side of the pair of adjacent cylinders (#2, #3), and the ignition coil unit (30) associated with the two second spark plugs (4) provided respectively in the remaining one (#1 or #4) of the at least three cylinders and one (#2 or #3) of the pair of adjacent cylinders closer to the remaining one (#1 or #4) of the at least three cylinders is composed of an integral-type ignition coil unit designed such that the connection pipe portion (32) is provided in a number of two for respective ones of the two second spark plugs (4), and the head portion (31) is shared by the two second spark plugs (4).

According to this feature, the ignition coil unit (30) for the respective second spark plugs (4) disposed in the two cylinders in adjacent relation to each other is formed as the integral-type ignition coil unit. This makes it possible to reduce an installation space required for the ignition coil unit (30) for two cylinders, and achieve enhanced efficiency of a maintenance operation.

When the engine (A) is an inline four-cylinder engine, it is preferable to employ the following arrangement. Two (#1, #2) of the four cylinders (#1 to #4) located on the first side of the engine (A) in a cylinder row direction are provided respectively with the second spark plugs (4) at positions adjacent to each other, and the remaining two cylinders (#3, #4) located on the second side of the engine (A) in the cylinder row direction are provided respectively with the second spark plugs (4) at positions adjacent to each other. The ignition coil unit (30) associated with the two second spark plugs (4) provided respectively in the two cylinders (#1, #2) on the first side is composed of the integral-type ignition coil unit, and the ignition coil unit (30) associated with the two second spark plugs (4) provided respectively in the remaining two cylinders (#3, #4) on the second side is composed of the integral-type ignition coil unit. Further, the head portion (21, 31) of each of the ignition coil units (20, 30) for the first and second spark plugs (3, 4) has a connector (21*a*, 31*a*) adapted to allow an electric wire to be connected thereto, wherein the connectors (21*a*, 31*a*) of all the ignition coil units (20, 30) are arranged to protrude toward one lateral side of the engine (A).

According to this feature, in the inline four-cylinder engine (A), an installation space for other component is formed at a position between two cylinders numbered 2 and 3, i.e., approximately at a middle position in the cylinder row direction. This makes it possible to more enhance the flexibility in design of the head cover (10). In addition, the connectors (21*a*, 31*a*) arranged to be oriented in the same direction make it possible to achieve enhanced efficiency of a maintenance operation.

More preferably, in the above upper structure, the head cover (10) is provided with an oil filler section (11) at a position apart from a central region of the head cover (10) in a direction orthogonal to the cylinder row direction, and between two cylinders (#2, #3) numbered 2 and 3 in the cylinder row direction.

According to this feature, the oil filler section (11) can be disposed in a lateral region of the head cover (10) at a middle position in the cylinder row direction.

When the engine (A) is transversely mounted in an engine compartment formed at a front end of a vehicle body, in such a manner that the cylinder row direction is oriented in a widthwise direction of the vehicle body, it is preferable that the connectors (21*a*, 31*a*) of all the ignition coil units (20, 30) are arranged to protrude toward one lateral side of the engine (A) on a frontward side of the vehicle body, and the oil filler section (11) is located on the frontward side of the vehicle body relative to a widthwise middle position of the head cover (10).

According to this feature, maintenance operations, such as an operation of connecting an electric wire to each of the connectors (21*a*, 31*a*), and an operation of replenishing oil, can be readily performed from a frontward end of the engine compartment.

More preferably, in the above upper structure, the integral-type ignition coil unit (30) includes a sealing member (31*c*, 32*a*) adapted to seal between the head cover (10) and the two connection pipe portions (32), wherein the sealing member (31*c*, 32*a*) is formed in an oval shape surrounding the two connection pipe portions (32).

According to this feature, sealing performance can be adequately ensured while allowing the two connection pipe portions (32) to be arranged closer to each other so as to facilitate reduction in size of the integral-type ignition coil unit (30).

This application is based on Japanese Patent Application No. 2007-289931 and No. 2008-260664, filed in Japan Patent Office on Nov. 7, 2007 and on Oct. 7, 2008, respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An upper structure of an engine having three or more cylinders arranged in a row, comprising:

a first spark plug provided in each of said cylinders and disposed approximately on a center line of a corresponding one of said cylinders;

a second spark plug provided in each of said cylinders and disposed apart from said first spark plug in a cylinder row direction; and an ignition coil unit connected to each of said first and second spark plugs, said ignition coil unit having a connection pipe portion adapted to be inserted into a plug hole and connected to said first or second spark plug through a distal end thereof, and a head portion provided on the side of a base end of said connection pipe portion and adapted to be exposed above a head cover of said engine, wherein:

a first one of a pair of adjacent cylinders among at least three of said cylinders serially arranged in said cylinder row direction is provided with said second spark plug at a position on an opposite side of a second one of said pair of adjacent cylinders; and said second one of said pair of adjacent cylinders is provided with said second spark plug at a position on an opposite side of said first one of said pair of adjacent cylinders.

2. The upper structure as defined in claim 1, wherein:

a remaining one of said at least three cylinders adjacent to said pair of adjacent cylinders is provided with said second spark plug at a position on the side of said pair of adjacent cylinders; and said ignition coil unit associated with said two second spark plugs provided respectively in said remaining one of said at least three cylinders and one of said pair of adjacent cylinders closer to said remaining one of said at least three cylinders is composed of an integral-type ignition coil unit designed such that said connection pipe portion is provided in a number of two for respective ones of said two second spark plugs, and said head portion is shared by said two second spark plugs.

3. The upper structure as defined in claim 2, wherein said engine is an inline four-cylinder engine, and wherein:

two of said four cylinders located on the first side of said engine in a cylinder row direction are provided respectively with said second spark plugs at positions adjacent to each other;

the remaining two cylinders located on the second side of said engine in said cylinder row direction are provided respectively with said second spark plugs at positions adjacent to each other;

said ignition coil unit associated with said two second spark plugs provided respectively in said two cylinders on the first side is composed of said integral-type ignition coil unit;

said ignition coil unit associated with said two second spark plugs provided respectively in said remaining two cylinders on the second side is composed of said integral-type ignition coil unit; and said head portion of each of said ignition coil units for said first and second spark plugs has a connector adapted to allow an electric wire to be connected thereto, said connectors of all said ignition coil units being arranged to protrude toward one lateral side of said engine.

4. The upper structure as defined in claim 3, wherein said head cover is provided with an oil filler section at a position apart from a central region of said head cover in a direction orthogonal to said cylinder row direction, and between two cylinders numbered 2 and 3 in said cylinder row direction.

5. The upper structure as defined in claim 4, wherein said engine is transversely mounted in an engine compartment formed at a front end of a vehicle body, in such a manner that said cylinder row direction is oriented in a widthwise direction of said vehicle body, and wherein:

said connectors of all said ignition coil units are arranged to protrude toward one lateral side of said engine on a frontward side of said vehicle body; and said oil filler section is located on the frontward side of said vehicle body relative to a widthwise middle position of said head cover.

6. The upper structure as defined in claim 2, wherein said integral-type ignition coil unit includes a sealing member adapted to seal between said head cover and said two connection pipe portions, said sealing member being formed in an oval shape surrounding said two connection pipe portions.

* * * * *